United States Patent [19]

Greenwood

[11] Patent Number: 4,904,507

[45] Date of Patent: Feb. 27, 1990

[54] INFORMATION DEVICE

[75] Inventor: David Greenwood, Oldham, England

[73] Assignee: Imperial Chemical Industries plc, London, England

[21] Appl. No.: 191,972

[22] Filed: May 9, 1988

[30] Foreign Application Priority Data

May 11, 1987 [GB] United Kingdom ..... 8711105

[51] Int. Cl.[4] ..... B41M 5/00

[52] U.S. Cl. ..... 428/29; 8/115; 428/195; 428/199; 428/690; 428/913

[58] Field of Search ..... 428/29, 195, 201, 904, 428/913, 199, 690; 8/478, 485, 115

[56] References Cited

U.S. PATENT DOCUMENTS 4,218,217 8/1980 Bedd, Jr. ..... 8/478

*Primary Examiner*—Pamela R. Schwartz

*Attorney, Agent, or Firm*—Cushman, Darby & Cushman

[57] ABSTRACT

An information device comprising a substrate having applied thereto:

(1) an agent which absorbs electromagnetic radiation in the infra-red to ultra-violet region of the spectrum, said agent being capable of easy removal from the substrate by physical means, and (2) a second agent which is capable of increasing the fixation of the first agent to the substrate, said second agent being applied to the substrate in a localized manner to form an invisible image which becomes detectable when the substrate is subjected to a treatment capable of selectively removing the first agent from those parts of the substrate to which the second agent has not been applied.

3 Claims, No Drawings

INFORMATION DEVICE

This invention relates to an information device in the form of a substrate which carries concealed information which becomes detectable by suitably treating the substrate.

According to the invention, there is provided an information device comprising a substrate having applied thereto:

(1) an agent which absorbs electromagnetic radiation in the infra-red to ultra-violet region of the spectrum, said agent being capable of easy removal from the substrate by physical means, and (2) a second agent which is capable of increasing the fixation of the first agent to the substrate, said second agent being applied to the substrate in a localised manner to form an invisible image which becomes detectable when the substrate is subjected to a treatment capable of selectively removing the first agent from those parts of the substrate to which the second agent has not been applied.

In a preferred embodiment, the first agent is one which absorbs radiation in the visible spectrum, especially a dye of a fugitive nature which has an affinity for the substrate but can readily be removed from the substrate in the absence of the second agent, for example by washing with an aqueous solvent, preferably water, optionally with the help of an abrasive treatment such as brushing or rubbing. The second agent is then preferably a dye fixing agent, many of which are known in the art.

Particularly suitable dyes for use in accordance with the invention are water-soluble anionic dyes. Such dyes may belong to any of the known chemical classes, for example the azo, anthraquinone, triphenodioxazine and phthalocyanine classes. Water-solubility will normally be provided by the presence of anionic groups, for example sulphonic acid, carboxylic acid or phosphonic acid groups which will commonly be in salt form. Suitable dyes include acid, direct and reactive dyes.

Dye fixing agents which may be used with anionic dyes are known in the art and particularly include cationic compounds which may be polymeric in structure, for example polyalkylene biguanides, polyethyleneimines and polyquaternary ammonium compounds.

Other dyes which may be used include water-soluble cationic dyes, also known as basic dyes, which may belong for example to the azo, triphenylmethane, phthalocyanine, xanthene, azine, oxazine, thiazine or acridine classes. Fixing agents which may be used in conjunction with cationic dyes include anionic polymers, for example poly(acrylic acid) and poly(vinylsulphonic acid).

The dye may be applied to the substrate in any convenient manner. For example, a cellulosic substrate such as a sheet of paper may be dipped in an aqueous solution of dye. The fixing agent may then be applied by printing or by some other convenient manner to form an invisible image which becomes visible when the coloured paper is washed, the unfixed dye being removed to a greater extent than the fixed dye. If desired, the pattern or design formed by the image may be a number or code.

Other substrates which may be employed include textile fabrics, plastics sheets and wood. The dye may be applied to the whole of the substrate or to a selected area thereof. The fixing agent may be applied to the substrate either before or after the dye, suitable application methods including writing, painting or printing using, for example, a brush, a ball or felt tip pen or an ink-jet printer.

The dye and fixing agent are preferably applied to the substrate from an aqueous medium, using either water alone or a mixture of water and a water-miscible solvent such as an alcohol and/or N-methylpyrrolidone, but non-aqueous solvents may be used if desired.

The information devices of the invention are useful for security purposes. For example, invisible codes may be applied to labels, lottery tickets, stationery, packaging and other articles. They may also be used in games, quiz books and educational aids and to provide concealed emblems and logos on clothing.

Although the invention has been largely described with reference to the use of dyes and dye fixing agents, it will be apparent to those skilled in the art that dyes could be replaced by agents which absorb in either the infra-red or ultra-violet region of the spectrum. Such agents, if anionic in nature, could be used in conjunction with the cationic fixing agents mentioned above. Examples of agents absorbing in the ultra-violet region include fluorescent brightening agents. Where the final image does not absorb in the visible spectrum, appropriate detection means for example ultra-violet lamps may be employed.

The invention is illustrated but not limited by the following Examples.

EXAMPLE 1

Preparation of Inks

2% ink of Acid Red 249

Dyestuff at 100% strength (0.4 g) is dissolved in the solvent mixture water:diethylene glycol:N-methylpyrrolidone, 6:3:1 (20 g). The solution is then screened through a 0.5$\mu$ nylon filter.

Acid Red 249 is an anionic monoazo dye in the form of a sodium salt.

3% ink of Fixing Agent, Polyhexamethylene Biguanide

Polyhexamethylene biguanide as a 20% solution in water (3 g) is added to water (9.6 g), diethylene glycol (6 g) and N-methylpyrrolidone (2 g). The mixture is stirred to give a clear solution and screened through a 0.45$\mu$ nylon filter.

Printing/Wash Off

The ink of the dyestuff Acid Red 249 is printed on to plain paper using a piezo-jet ink-jet printer for example Colour Jet 132 ex or PJ 1210 ex.Canon. The colour is printed in a block form.

The ink of the fixing agent is subsequently overprinted on the above block of colour in the required image. The image is not detectable.

The formed image may be revealed by treating the print with water or an aqueous based solvent system, by e.g. washing, or brushing. The washing procedure removes unfixed dye leaving the fixed image.

An alternative procedure is to print with the ink of the fixing agent on to plain paper in the required image. The image is not readily detected.

A coloured image may be subsequently formed by dipping the print in a solution of Acid Red 249 and then dipping in water to remove unfixed dyestuff. Dyestuff is retained by the fixing agent to produce a coloured image.

EXAMPLE 2

Preparation of Inks

3% ink of C.I. Food Black 2

Dyestuff at 100% strength (0.6 g) is dissolved in a mixture of water:diethylene glycol (9:1) (19.4 g). The solution is then screened through a 0.5μ nylon filter.

C.I. Food Black 2 has the structure:

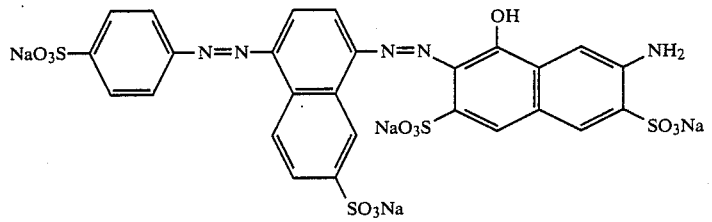

3% ink of Fixing Agent, 3-3-Ionene bromide

The polyquaternary ammonium reagent, 3-3-Ionene bromide, of weight average mol wt 15,000, (0.6 g) is dissolved in water:diethylene glycol (9:1) (19.4 g). The solution is screened through a 0.45μ nylon filter.

Printing/Wash Off

The ink of the dyestuff C.I. Food Black 2 is printed on to plain white paper using a piezo-jet ink-jet or thermal ink-jet printer. The colour is printed in a block form.

The ink of the fixing agent is subsequently overprinted on the above block of colour in such a way as to fix all the dye except dye in the shape of the required image. The image is not detectable.

The image may be revealed by immersion of the printed pattern in warm water for 2–3 minutes and rinsing with warm water to fully remove all unfixed dye if required. The image is white on a black background.

EXAMPLE 3

Preparation of Inks

2% ink of C.I. Direct Blue 87

Dyestuff at 100% strength (0.4 g) is dissolved in the solvent mixture water:isopropanol (80:20) (19.6 g). The solution is then screened through a 0.5μ nylon filter.

C.I. Direct Blue 87 is a sodium salt of trisulphonated copper phthalocyanine.

3% ink of Fixing Agent, Poly(1,1-dimethyl-3,5-dimethylenepiperidinium chloride

The fixing agent as a 20% solution in water (2 g) is added to water (14.lg) and isopropanol (3.9 g). The mixture is stirred and the resulting solution is screened through a 0.45μ nylon filter.

Printing/Wash Off

The ink of the dyestuff is printed on to cotton fabric using a piezo-jet ink-jet printer or by screen printing. The colour is printed in block form.

The ink of the fixing agent is then overprinted on the above block of colour in the required image. The image cannot be seen.

The formed image is revealed by treating the printed cotton with water or a water/alcohol mixture (water >70%). This may be done by brushing, wiping or immersion in the wash off medium.

The image is coloured blue on the white background of the fabric.

EXAMPLE 4

Preparation of Inks

2% ink of C.I. Fluorescent Brightener 28

The fluorescent brightener at 100% strength (0.4 g) is dissolved in the solvent mixture water:diethylene glycol (80:20) (19.6 g). The solution is then screened through a 0.5μ nylon filter. C.I. Fluorescent Brightener 28 has the structure:

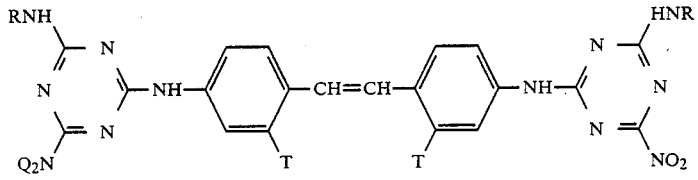

in which R is phenyl, Q is 2-hydroxyethyl and T is —$SO_3Na$.

2% ink of Fixing Agent, Polyhexamethylene biguanide (PHMB)

PHMB as a 20% solution in water (2 g) is added to water (17 g) and diethylene glycol (lg). The mixture is stirred to homogenise and the resulting solution is screened through a 0.45μ nylon filter.

Printing/Wash Off

The ink of FBA is printed on to plain paper using a piezo or thermal ink-jet printer in block form.

The ink of the fixing agent is then overprinted on the above block of colour in the required image.

The block of printed paper is only clearly distinguishable when viewed under ultraviolet light and the image is not discernible.

The concealed image may be revealed by washing the print with water thus removing unfixed FBA. The image is then revealed under ultraviolet light.

Examples of other anionic dyes which may be used in place of any of the dyes used in Examples 1–3 have the following structures, the dyes generally being employed in the form of their alkali metal salts, for example sodium salts.

C.I. Direct Black 51

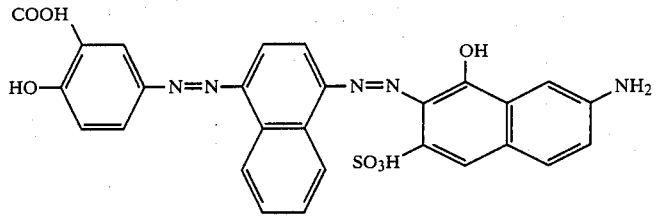

C.I. Direct Black 168

C.I. Direct Yellow 50

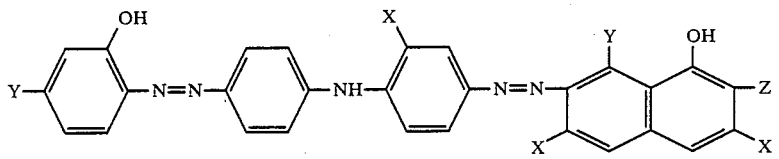

in which Y is —$NH_2$, X is —$SO_3H$ and Z is phenylazo.

C.I. Direct Blue 199

CuPc $(SO_3H)_2$ $(SO_2NH_2)$

C.I. Acid Blue 249

CuPc $(SO_3H)_4$

C.I. Acid Red 35

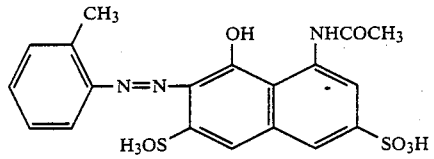

C.I. Acid Red 37

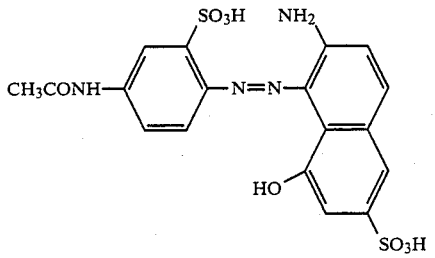

C.I. Direct Yellow 84

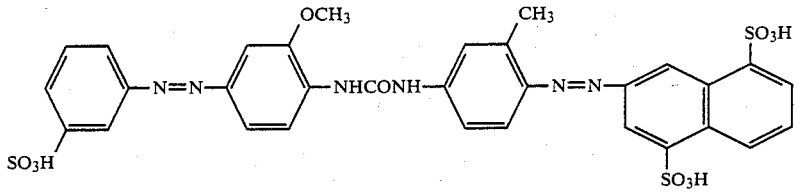

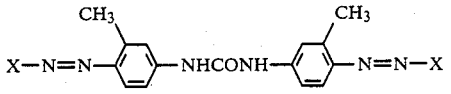

in which X is 4,8-disulphonaphth-2-yl

C.I. Reactive Orange 88

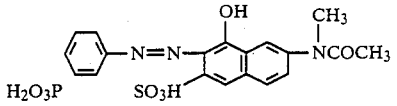

Examples of other fluorescent brighteners which may be used in place of C.I. Fluorescent Brightener 28 in Example 4 include:

C.I. Fluorescent Brightener 34

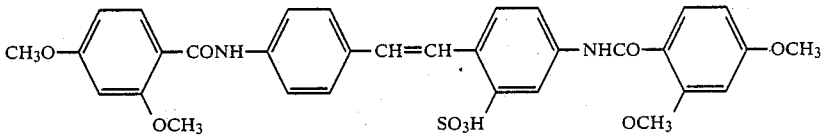

Examples of other fixing agents which may be used in place of any of the fixing agents used in Examples 1–4 include poly(ethyleneimine), 3-3-Ionene chloride having the structure:

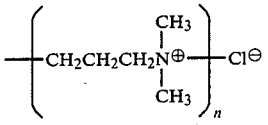

in which n is from 25 to 300, and dicyandiamide/naphthalene condensates.

Examples of solvents which may be used in place of any of the solvents used in Examples 1–4 include water/diethylene glycol mixtures containing from 5 to 40% of diethylene glycol, water/diethylene glycol/N-methylpyrrolidone mixtures containing 60–80% of water, 10–35% of diethylene glycol and 1–10% of N-methylpyrrolidone, water/alcohol mixtures, such as an 80/20 water/isopropanol mixture.

Examples of substrates which may be used in place of the substrates used in Examples 1–4 include fabrics made from cotton, cotton/polyester blends, nylon, nylon/wool blends, acetate rayon, wool or wool blends. Wood based laminates may also be used.

EXAMPLE 5

Preparation of Inks

2% ink of C.I. Basic Orange 1

Dyestuff at 100% strength (0.4 g) is dissolved in the solvent mixture water:diethylene glycol (0.95:0.5) (19.6 g). The solution is screened through a 0.5μ nylon filter. C.I. Basic Orange 1 has the structure:

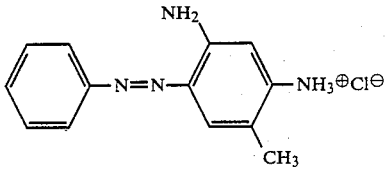

3% ink of Fixing Agent, Poly(acrylic acid)

Poly(acrylic acid) (average mol wt 90,000) as a 20% solution in water (3 g) is added to a water (16.2 g) and diethylene glycol (lg) mixture. The resulting mixture is stirred to homogenise and the solution is screened through a 0.5μ nylon filter.

Printing/Wash Off

The ink of the dyestuff C.I. Basic Orange 1 is printed on to a Polyester/Cotton blend (67:33) using an ink-jet printer. The colour is printed in block form.

The ink of the fixing agent is subsequently overprinted on the above block of colour in the message required. The message is not detectable in visible or ultraviolet light.

The message may be revealed by immersion of the print in warm, running water for approximately 30 seconds.

Examples of other cationic dyes which may be used in place of C.I. Basic Orange 1 in Example 5 include C.I. Basic Blue 33.1 having the structure:

$$CuPc—[CH_2N(C_2H_5)_2]_3.HCl$$

Examples of other anionic fixing agents which may be used in place of poly(acrylic acid) in Example 5 include poly(vinylsulphonic acid) as the sodium salt.

I claim:

1. An information device comprising a substrate having applied thereto:
   (1) a dye or florescent brightener which has an affinity for the substrate but is capable of easy removal from the substrate by physical means, and
   (2) a fixing agent which is capable of increasing the fixation of the dye or florescent brightener to the substrate, said fixing agent being applied to the substrate in a localized manner to form an invisible image which becomes detectable when the substrate is subjected to a treatment capable of selectively removing the dye or florescent brightener from those parts of the substrate to which the fixing agent has not been applied.

2. An information device according to claim 1 wherein the dye is a water-soluble anionic dye and the fixing agent is a cationic fixing agent.

3. An information device according to claim 1 wherein the dye is a water-soluble cationic dye and the fixing agent is an anionic fixing agent.

* * * * *